US011577520B2

(12) United States Patent
McDaniel et al.

(10) Patent No.: US 11,577,520 B2
(45) Date of Patent: Feb. 14, 2023

(54) REFILL CONTAINERS WITH PRESSURIZED FLUID CHAMBERS

(71) Applicant: HEWLETT-PACKARD DEVELOPMENT COMPANY, L.P., Spring, TX (US)

(72) Inventors: Gabriel Scott McDaniel, Boise, ID (US); Jeffrey Harold Luke, Boise, ID (US); Sean Daniel FitzGerald, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 119 days.

(21) Appl. No.: 17/260,273

(22) PCT Filed: Nov. 8, 2018

(86) PCT No.: PCT/US2018/059837

§ 371 (c)(1),
(2) Date: Jan. 14, 2021

(87) PCT Pub. No.: WO2020/096605

PCT Pub. Date: May 14, 2020

(65) Prior Publication Data

US 2021/0283919 A1 Sep. 16, 2021

(51) Int. Cl.
*B41J 2/175* (2006.01)
*B41F 31/00* (2006.01)

(52) U.S. Cl.
CPC ..... *B41J 2/17506* (2013.01); *B41F 31/00* (2013.01)

(58) Field of Classification Search
CPC .... B41J 2/17506; B41J 2/17513; B41J 2/175; B41J 2/17509; B41J 2/17503; B41F 31/02; B41F 31/022
See application file for complete search history.

(56) References Cited

U.S. PATENT DOCUMENTS

| | | | |
|---|---|---|---|
| 6,067,906 | A | 5/2000 | Ryan et al. |
| 6,074,050 | A | 6/2000 | Perez et al. |
| 6,243,115 | B1 | 6/2001 | Baker et al. |
| 7,543,925 | B2 | 6/2009 | Ishizawa et al. |
| 8,113,612 | B2 | 2/2012 | Levy et al. |
| 8,960,870 | B2 | 2/2015 | Laramie et al. |
| 2006/0238582 | A1 | 10/2006 | Silverbrook |
| 2007/0158371 | A1 | 7/2007 | Lupfer |
| 2017/0232753 | A1 | 8/2017 | Tomlin |
| 2018/0236120 | A1 | 8/2018 | Joshi |

FOREIGN PATENT DOCUMENTS

| | | | |
|---|---|---|---|
| EP | 0754556 | A2 | 1/1997 |
| WO | WO-03016062 | A1 | 2/2003 |
| WO | WO-2009049348 | A1 | 4/2009 |

*Primary Examiner* — Jannelle M Lebron
(74) *Attorney, Agent, or Firm* — Foley & Lardner LLP

(57) ABSTRACT

In one example in accordance with the present disclosure, a refill container is described. The refill container includes a reservoir to house a volume of print compound and a chamber to house a pressurized fluid. A wall separates the reservoir from the chamber. A pressure release device of the refill container creates a fluid path between the chamber and the reservoir such that the pressurized fluid flows into the reservoir to mix with the volume of print compound. A trigger of the refill container activates the pressure release device.

20 Claims, 10 Drawing Sheets

REFILL CONTAINERS WITH PRESSURIZED FLUID CHAMBERS

BACKGROUND

Printing systems include multiple components used in forming markings on a print target. Different printing systems dispense different types of print compound on a print target surface. For example, a two-dimensional (2D) printer ejects wet print compound such as ink, or dry compound such as toner, to form images/text on print media. In another example, a three-dimensional (3D) printer ejects fluid, such as a fusing agent, onto a bed of build material. Other types of printers may eject other compounds such as other fluids, metallic components, compounds, particulates, or other matter onto any variety of surfaces including, but not limited to, a flat surface, a mold, or other pre-formed casing or structure. This print compound material is supplied from an integrated reservoir, cartridge, container, or vessel. Replaceable reservoirs, cartridges, containers, or vessels may be used to replenish the integrated reservoir, cartridge, container, or vessel with additional print compound.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
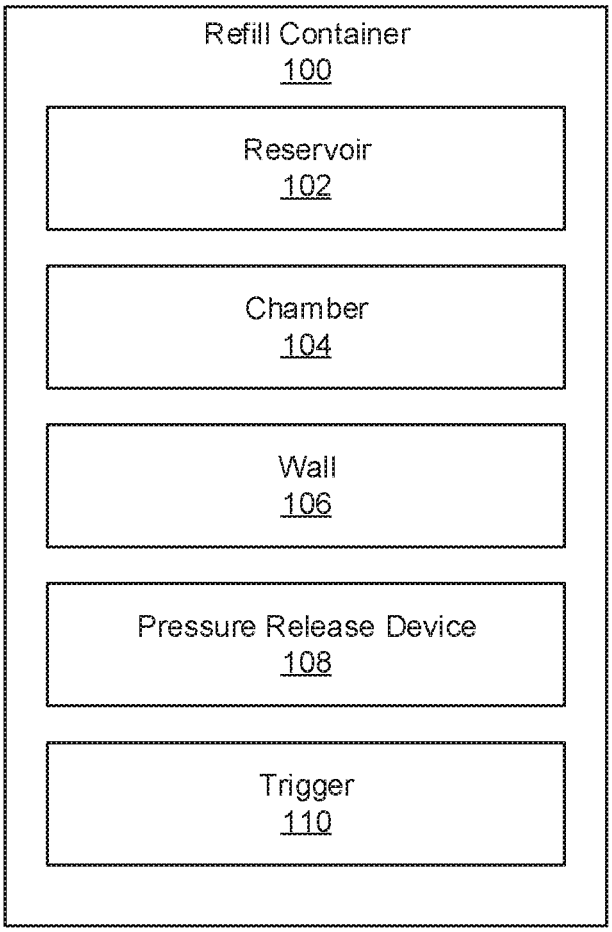
FIG. 1 is a block diagram of a refill container with a pressurized fluid chamber, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As described above, printing systems in general dispense print compound to form of images, text, patterns, shapes, figures, and/or three dimensional structures. The compound may be dispensed on any variety of surfaces including paper, a container, a mold, or other structure. Different printing systems dispense different print compounds. For example, the print compound may be dry, or particle-based such as toner. In other examples, the print compound may be a liquid, such as liquid ink. Other types of compound may also be deposited on the surface via a printing system. For example, a three-dimensional printer may deposit a powder material that is to be sintered, fused, or that is to be otherwise solidified. Such a three-dimensional printer may also deposit an agent, which is dry, wet, or light-emission based. The agent facilitates the solidifying of the powder material into a three-dimensional object. Over time, these print compounds are used, and the repositories from which they are drawn are depleted. Accordingly, temporary or replaceable reservoirs may be coupled to a permanent reservoir on the printing system. These temporary or replaceable reservoirs include additional print compound that replenishes the printing system repository.

While such replaceable volumes provide an effective way to provide a printing system with additional print compound, using them may be complicated and can lead to waste. For example, physically handling a replacement reservoir and coupling it to a printing system can be difficult, awkward, messy, and could lead to inadvertent release of the print compound into the local environment. For some individuals, the handling of such equipment may not even be possible.

Moreover, it may be difficult to completely extract the contents of the replacement reservoirs leaving some of the print compound remaining in the replacement reservoir. This results in wasted material, which may be a financial loss to both consumer and producer.

Accordingly, the present specification describes a system wherein a refill of a printing system reservoir is simplified. Specifically, the refill container contains a pressurized fluid (i.e., liquid or gas) in a chamber that is either itself sealed or includes a sealed vessel. This chamber is punctured or otherwise compromised to allow for the release of pressurized fluid into the reservoir of the refill container where the print compound is held. The pressure differential between the chamber (now open) and the print compound reservoir, causes the pressurized fluid to rush into the print compound reservoir, agitating the print compound particles such that they are more easily ejected from the replacement reservoir into the printing device reservoir. The pressurized gas also provides a force that pushes, or otherwise directs, the print compound through an outlet of the replacement reservoir.

Specifically, the present specification describes a refill container. The refill container includes a reservoir to house a volume of print compound and a chamber to house a pressurized fluid. The refill container also includes a wall to separate the reservoir from the chamber. A pressure release device of the refill container creates a fluid pathway between the chamber and the reservoir such that the pressurized fluid flows into the reservoir to mix with the volume of print compound. A trigger of the refill container activates the pressure release device.

The present specification also describes a method. According to the method, a refill container that is coupled to a printing system is authenticated. In this example, the refill container includes a reservoir to house a volume of print compound and a chamber to hold a pressurized fluid that agitates/mobilizes the print compound when mixed. Following authentication of the refill container, the print compound is agitated via introduction of a pressurized fluid into the print compound reservoir. The print compound is then received into a printing system reservoir.

In another example, the refill container includes the reservoir, the chamber, the wall, and the pressure release device. In this example, the refill container includes a cap with a trigger to activate the pressure release device and a security device that includes information to authenticate the refill container.

In summary, using such a refill container 1) eliminates the need for a user to use their own physical force to pressurize the internal volume of the refill container; 2) eliminates the need for multiple external components to eject the print compound; 3) simplifies the print compound refill operation; and 4) simplifies manufacturing and transportation logistics by reducing the overall size of the refill container.

Turning now to the figures, FIG. 1 is a block diagram of a refill container (100) with a pressurized fluid chamber (104), according to an example of the principles described herein. As described above, the refill container (100) may refer to any reservoir that holds a compound, such as a print compound, that is to replenish a printing system with addition compound. That is, the print compound in a printing system depletes over time as the printing system is used to carry out its intended function of depositing the print compound onto and/or into a print target. Accordingly, the refill container (100) may be a replaceable reservoir that is separate from the printing system and connectable to the printing system to refill the integrated reservoir of the printing system.

The refill container (100) includes a reservoir (102) to hold a volume of print compound. The reservoir (102) may hold any variety of print compound. For example, the print compound may be powdered toner, or another composite of materials/print particulates, that is used by a printing system to form images, text, and/or other patterns on a target such as paper. In another example, the print compound may be a build material that is to be deposited in a three-dimensional printing system for forming three-dimensional objects. Examples of such build materials include metallic substances, atomic structures, molecules, composites, organic materials, or combinations thereof. This reservoir (102) includes an outlet through which the print compound is expelled. The reservoir (102) may be formed of any material including plastic and may be rigid. In one specific example, the reservoir (102) may be formed of a cellulose material or other organic material that can be compacted into a rigid form. In another example, the reservoir (102) may be flexible, such as a bag that contains the print compound.

The refill container (100) also includes a chamber (104) that is disposed with the same housing as the reservoir (102) but is initially fluidly separated from the reservoir (102). In some examples, the contents of the chamber (104) do not mix with those of the reservoir (102) until the wall between them is ruptured or opened. That is, the chamber (104) is sealed from the reservoir (102). In another example, the chamber (104) includes a vessel that is sealed and whose contents do not mix with those of the reservoir (102) until the vessel is opened.

The chamber (104), either directly or indirectly through a vessel disposed therein, houses a mobilizer. That is, the chamber (104) houses a compound that when combined with the print compound in the reservoir (102) increases the mobility of the print compound such that it is more easily expelled from the refill container (100). The mobilizer also provides the energy to move the print compound out the outlet of the reservoir (102).

The mobilizer can be of varying types. That is, the chamber (104) houses a pressurized fluid, however the pressurized fluid may be of varying types. For example, the pressurized fluid may be a pressurized gas. Such a gas may be of varying types so long as it is inert and does not pose any danger to a user or to the contents of the reservoir (102). Examples of such gas include pressurized air, nitrogen, argon, or other inflammable inert gases. In another example, the pressurized fluid may be liquid that is under pressure when sealed within the chamber (104), but that becomes gaseous at standard temperature and pressure that is when the wall (106) is ruptured.

In yet another example, the chamber includes sub-chambers. That is, a first chamber may include a liquid and is separated from a second chamber that also includes a liquid. A seal between the two sub-chambers may be ruptured, or a valve depressed, to allow the two liquids to mix and undergo a chemical reaction where they are converted from liquid form to a gaseous form. Doing so increases the pressure within the chamber (104) which is then released when the chamber (104) is put in fluid communication with the reservoir (102).

A wall (106) separates the reservoir (102) from the sealed chamber (104). The wall (106) may take many forms. For example, as will be described below, the wall (106) may be a thin metallic membrane to be ruptured. In another example, the wall (106) may be rigid and have a valve disposed therein. In either case, the wall (106) is a barrier between the reservoir (102) and the sealed chamber (104), but is rupturable or otherwise openable to allow the pressurized contents of the sealed chamber (104) to mix with the print compound in the reservoir (102).

The refill container (100) also includes a pressure release device (108) to create a fluid pathway between the chamber (104) and the reservoir (102) such that the pressurized fluid flows into the reservoir (102) to mix with the volume of the print compound. In a sealed state, the print compound in the reservoir (102) may be at rest. However, when the wall (106) is ruptured or the pressurized fluid in the chamber (104) is otherwise put in fluid contact with the reservoir (102), the pressure differential causes the pressurized fluid to enter the reservoir (102) with a force that disturbs the contents therein. This disturbance makes the print compound easier to move. The movement of the pressurized fluid also provides the energy to direct the print compound out the outlet. Accordingly, in some examples, the wall (106) may be on an opposite side of the reservoir (102) from the outlet. The pressure release device (108) may take many forms. For example, the pressure release device (108) may be a pin, blade, or other geometric feature that serves to compromise the sheer-strength of the material that forms the membrane wall (106). In another example, the pressure release device (108) may be a plunger that depresses, or opens, a valve on the wall (106). In yet another example, the pressure release device (108) may be a lever that displaces a portion of the wall. For example, the lever may break a seal between the chamber (104) and a sidewall of the refill container (100). In yet another example, the pressure release device (108) may be a shape that upon rotation and/or translation, collects, pulls, or otherwise compromises the seal by pulling the wall (106) away from sidewalls of the refill container to break or otherwise compromise the seal therebetween.

To activate the pressure release device (108), the refill container (100) includes a trigger (110) or other component or mechanism to activate the pressure release device (108). The trigger (110) is a component acted upon by a user, or a mechanism within the printing system, that actuates the pressure release device (108). The trigger (110) may be mechanically moved in a variety of ways to activate the pressure release device (108). For example, the trigger (110)

may translate to activate the pressure release device (108). For example, a user may push a cap or button or other component or mechanism, which is rigidly coupled to a pin or plunger. In this example, the translation causes the pin or plunger to interact with the wall (106) to rupture or open a valve in the wall (106). In another example, the trigger (110) rotates to activate the pressure release device (108). For example, the trigger (110) may be a cap with internal threading that interacts with threading on the refill container (100) housing. As the cap is rotated, the threads engage to draw the pressure release device (108), i.e., the pin or plunger, into contact with the wall (106) to rupture or otherwise open it. While specific reference is made to different pressure release device (108) mechanisms and different triggers (110) for activating the pressure release device (108) any such devices may be implemented to unseal the sealed chamber (104) and to activate such a pressure release device (108). Moreover, as described above, the trigger (110) may be acted upon by a user. In other examples, the trigger (110) is acted upon by a mechanism within the printing system. That is, the printing system may have an auto-release function that triggers activation of the components of the refill container (100).

Figure 2:
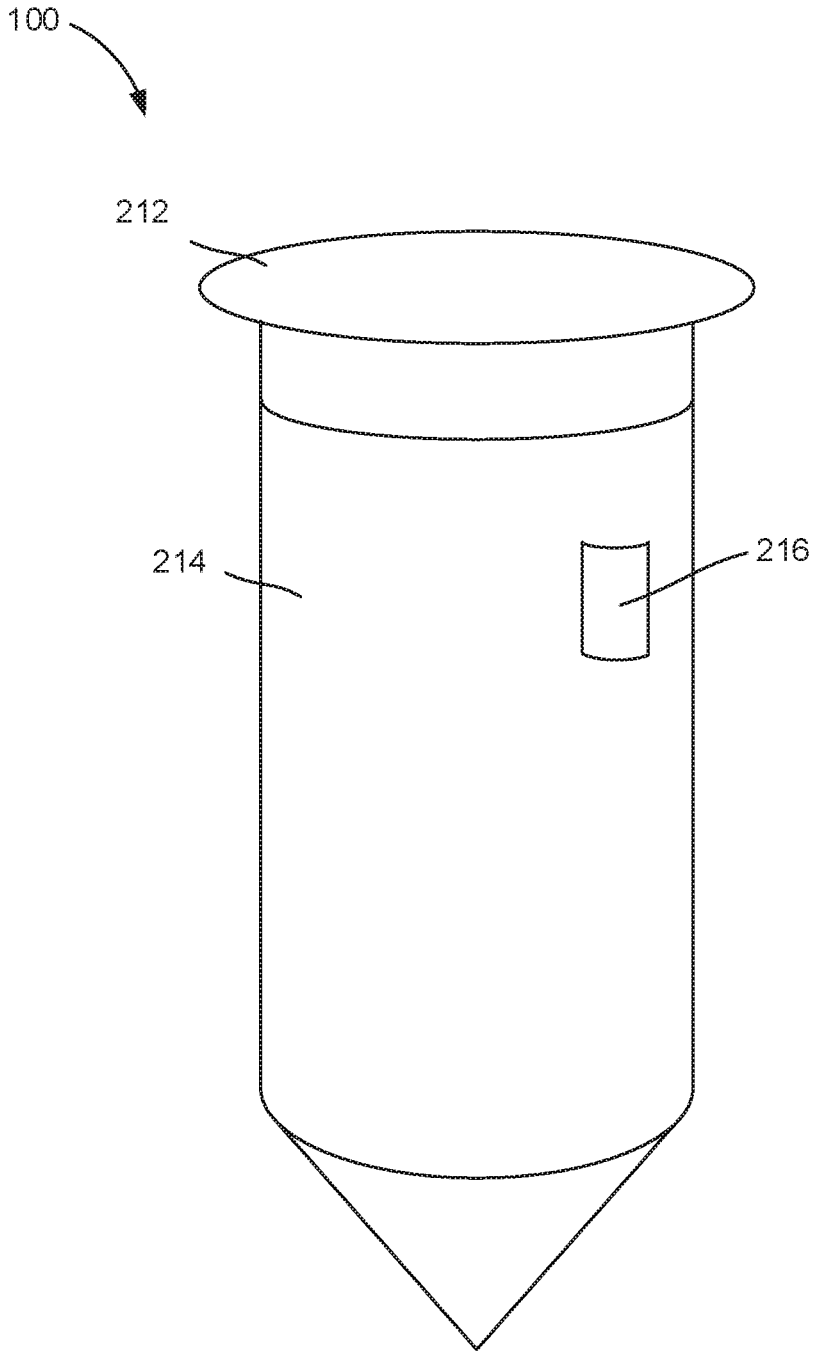
FIG. 2 is an isometric view of a refill container with a pressurized fluid chamber, according to an example of the principles described herein.

FIG. 2 is an isometric view of a refill container (100) with a pressurized fluid chamber (FIG. 1, 104), according to an example of the principles described herein. Specifically, FIG. 2 depicts the refill container (100) as a cylindrical housing (214). While FIG. 2 depicts a cylindrical housing (214), the housing (214) may be any shape such as a housing (214) with a triangular cross section or a housing (214) with a rectangular cross section.

Within the housing (214) are disposed the reservoir (FIG. 1, 102), the chamber (FIG. 1, 104), and the wall (FIG. 1, 106) that separates the two. FIG. 2 also depicts a cap (212) that is disposed on top of the housing (214). The cap (212) may move relative to the housing (214). For example, the cap (212) may translate and/or rotate relative to the housing (214).

As described above, in some examples the cap (212) acts as the trigger (FIG. 1, 110) that is acted upon by a user or by a printing system in which the refill container (100) is installed and that triggers the pressure release device (FIG. 1, 108) to allow the pressurized fluid in the chamber (FIG. 1, 104) to mix with the print compound in the reservoir (FIG. 1, 102).

In some examples, the refill container (100) includes a security device (216). The security device (216) may include information by which the refill container (100) may be authenticated. For example, the security device (216) may include a unique identifier which is encoded. Upon insertion into a printing system, the unique identifier may be decoded to determine whether the refill container (100) is from an authorized source or otherwise authorized to be used in the printing system.

In some examples, actuation of the pressure release device (FIG. 1, 108) may be gated by the information disposed on the security device (216). For example, the printing system may include a mechanical stop that prevents the cap (212) from being translated to rupture the wall (FIG. 1, 106) membrane. Once the refill container (100) is authenticated, the printing system may remove, move, clear-away, or otherwise disengage the mechanical stop, allowing the cap (212) to activate the pressure release device (FIG. 1, 108) to facilitate the refilling operation.

In addition to the authentication information described above, the security device (216) may include other information such as the characteristics of the print compound contained therein. Based on this information, the printing system may alter the operation of at least one operational characteristic of the printing system. For example, the printing system may adjust the ejection characteristics of the print compound based on print compound characteristics collected from the security device (216).

The security device (216) may take many forms. It may be a human-indiscernible pattern such as a quick response code, a barcode, a matrix code, or any other pattern of images and/or alphanumeric characters that uniquely identifies the refill container (100) or otherwise indicates its authenticity and authorized use within the printing system. The human-indiscernible pattern may be encrypted or otherwise secured to prevent unintentional interpretation of the security device (216).

Figure 3A:
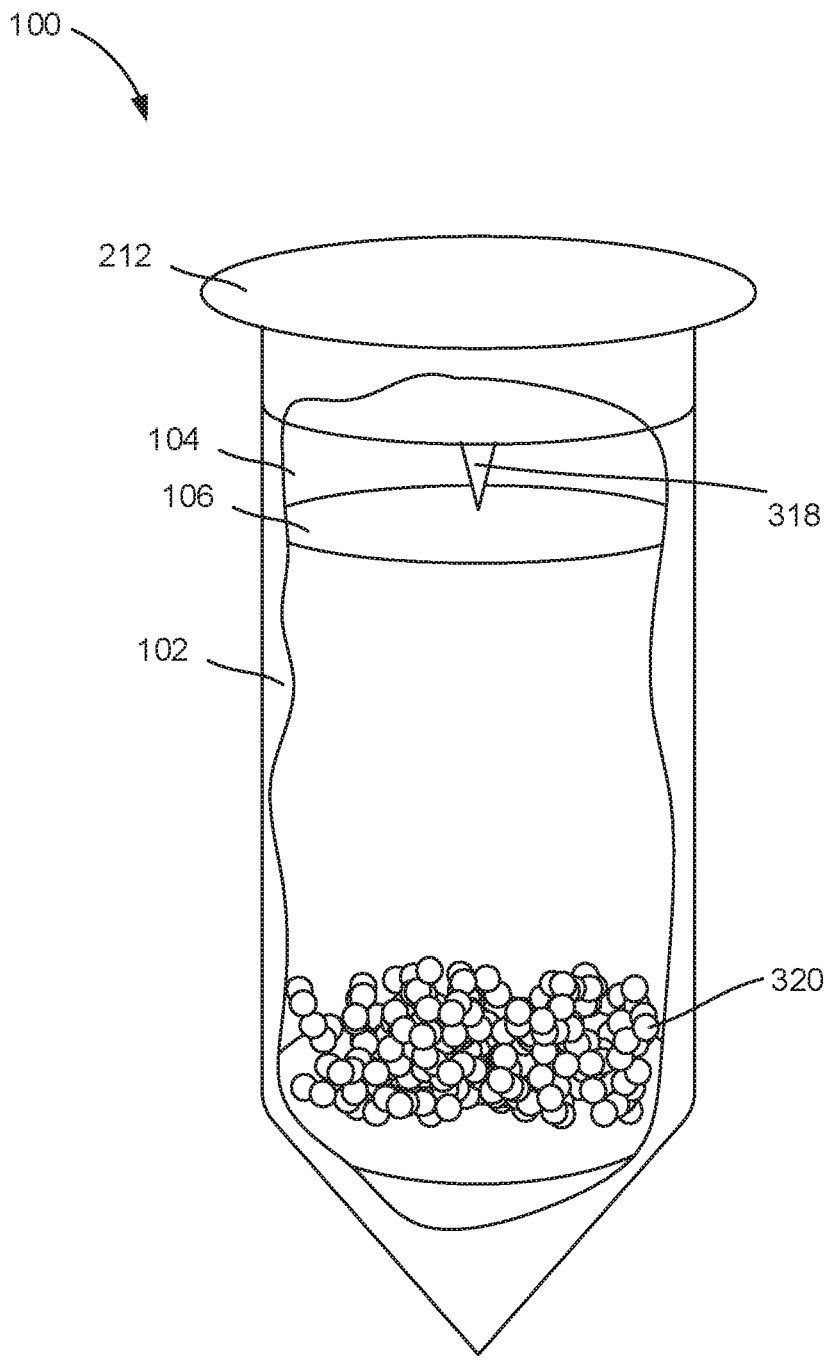
FIGS. 3A and 3B are views of a refill container with a pressurized fluid chamber, according to an example of the principles described herein.
Figure 3B:
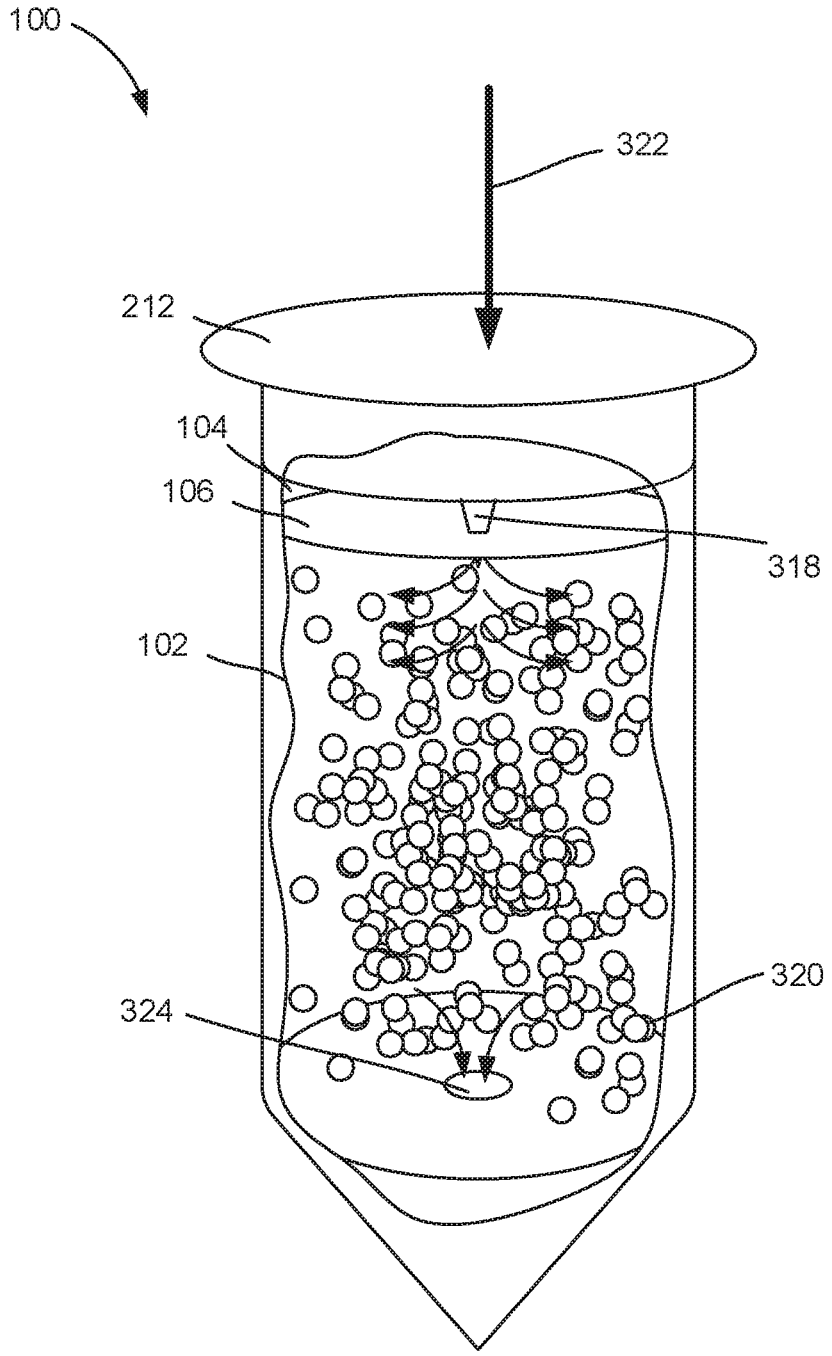

FIGS. 3A and 3B are views of a refill container (100) with a pressurized fluid chamber (104), according to an example of the principles described herein. More specifically, FIGS. 3A and 3B depict the refill container (100) with a portion of the housing (FIG. 2, 210) removed to illustrate components therein.

FIGS. 3A and 3B depict an example where chamber (104) is a sealed chamber, the wall (106) is a membrane, and the pressure release device (FIG. 1, 108) ruptures the membrane. More specifically, FIG. 3A is a view before rupture of the wall (106) and FIG. 3B is a view following rupture of the wall (106). As depicted in FIG. 3A, print compound (320), in this example a particulate-type print compound (320), is at rest in the reservoir (102). Note that in FIGS. 3A and 3B among others, the print compound (320) is not drawn to scale and individual particles are enlarged to highlight certain aspects of the refill container (100). With the print compound (320) at rest, it may be difficult to extract all the print compound (320) from the reservoir (102). As described in FIG. 3B, the rupturing of the membrane wall (106) addresses this issue.

FIG. 3A also clearly depicts the wall (106), which in this case is a membrane. In this example, the membrane may be formed of any material such as an aluminum sheet or other thin material that is rupturable. However, in other examples, the membrane may be of other forms such as a surface that is collected or removed. In this example, the membrane may not be ruptured, but pulled away from walls and/or floor of the chamber (104).

Returning to the rupturable membrane, in this example, the pressure release device (FIG. 1, 108) is a pin (318) that ruptures the membrane wall (106). As described above, the pin (318) may be actuated in any number of ways including a translation or a rotation of the trigger (FIG. 1, 110) which in this case is a cap (212) of the refill container (100).

FIG. 3B depicts the refill container (100) following activation of the pressure release device (FIG. 1, 108). That is, the pin (318) has ruptured the membrane wall (106). In the example depicted in FIG. 3B, such an activation results from a user, or a component within the printing system, translating the cap (212) in a direction indicated by the arrow (322). That is, as the cap (212) is pushed down, the pin (318) is also pushed down to rupture the membrane wall (106). While FIG. 3B depicts a translation of the cap (212), other, or additional, actions may activate the pressure release device (FIG. 1, 108) such as a rotation of the cap (212) or other mechanical activity.

As described above, when the cap (212) causes the pressure release device (FIG. 1, 108) to rupture the wall (106) membrane, the contents of the chamber (104), that is the pressurized fluid, rush into the lower pressure reservoir (102) as indicated by the arrows. Such an action disturbs or agitates the print compound (320) such that it mobilizes throughout the space within the reservoir (102). In such an agitated state, the print compound (320) is more disposed to be acted upon by a mobilizing energy. The energy of the rushing pressurized fluid is such a mobilizing energy and pushes the print compound (320) through the outlet (324). That is, the released pressure that results from the rupture of the membrane wall (106), increases the rate of print compound (320) release by 1) agitating the print compound (320) into a state where it is more readily acted upon by an external force and 2) providing a force that directs the print compound (320) through the outlet (324). The increased mobility and directed force produced by the pressurized fluid results in a greater rate, and a greater overall volume, of ejected print compound (320). That is, less print compound (320) remains in the refill container (100) thus resulting in a more efficient refill operation.

Such a rupturable membrane wall (106) may provide a simple, one action refill operation. That is, by a single motion such as a depression of the cap (212), the entire contents of the print compound reservoir (102) may be released through the outlet (324) into the printing system reservoir.

Figure 4A:
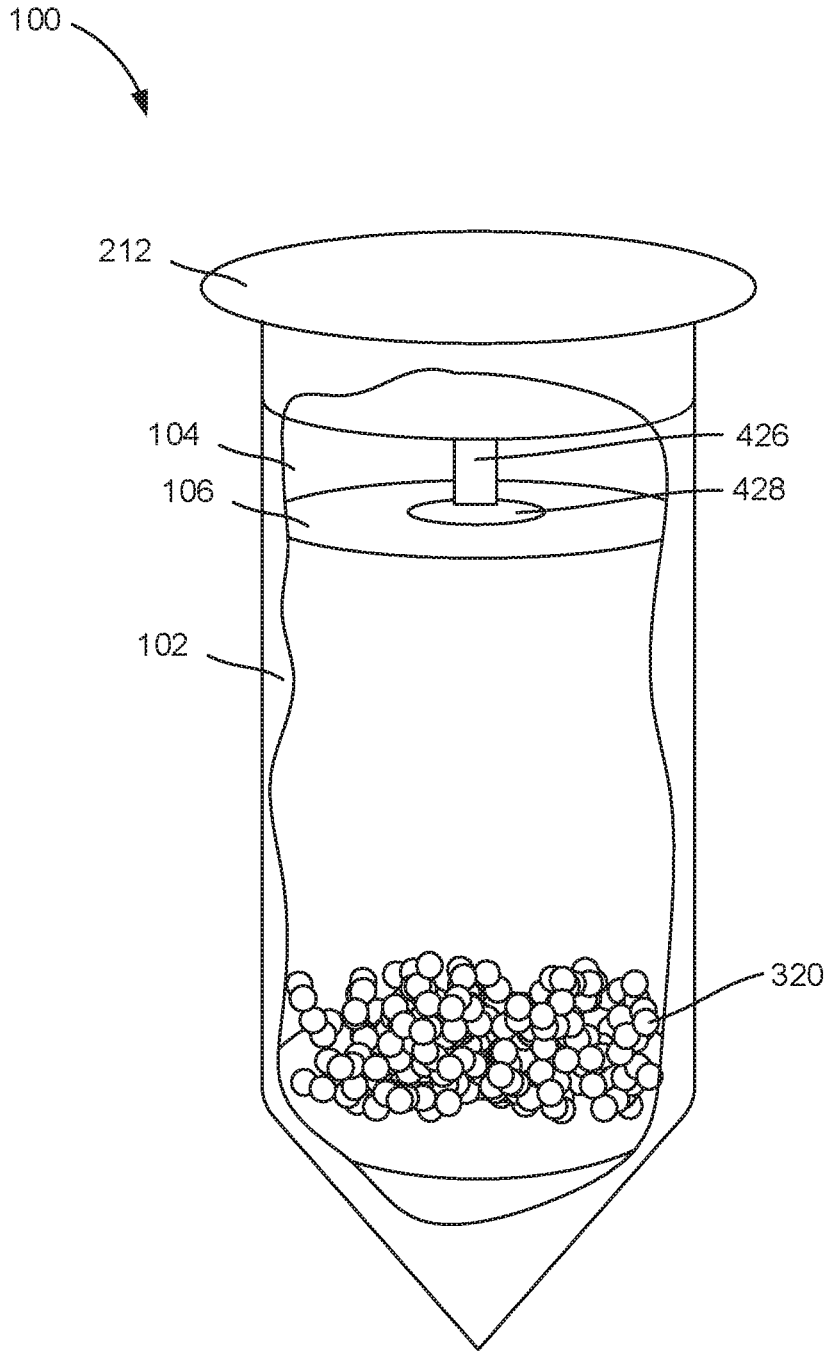
FIGS. 4A and 4B are views of a refill container with a pressurized fluid chamber, according to another example of the principles described herein.
Figure 4B:
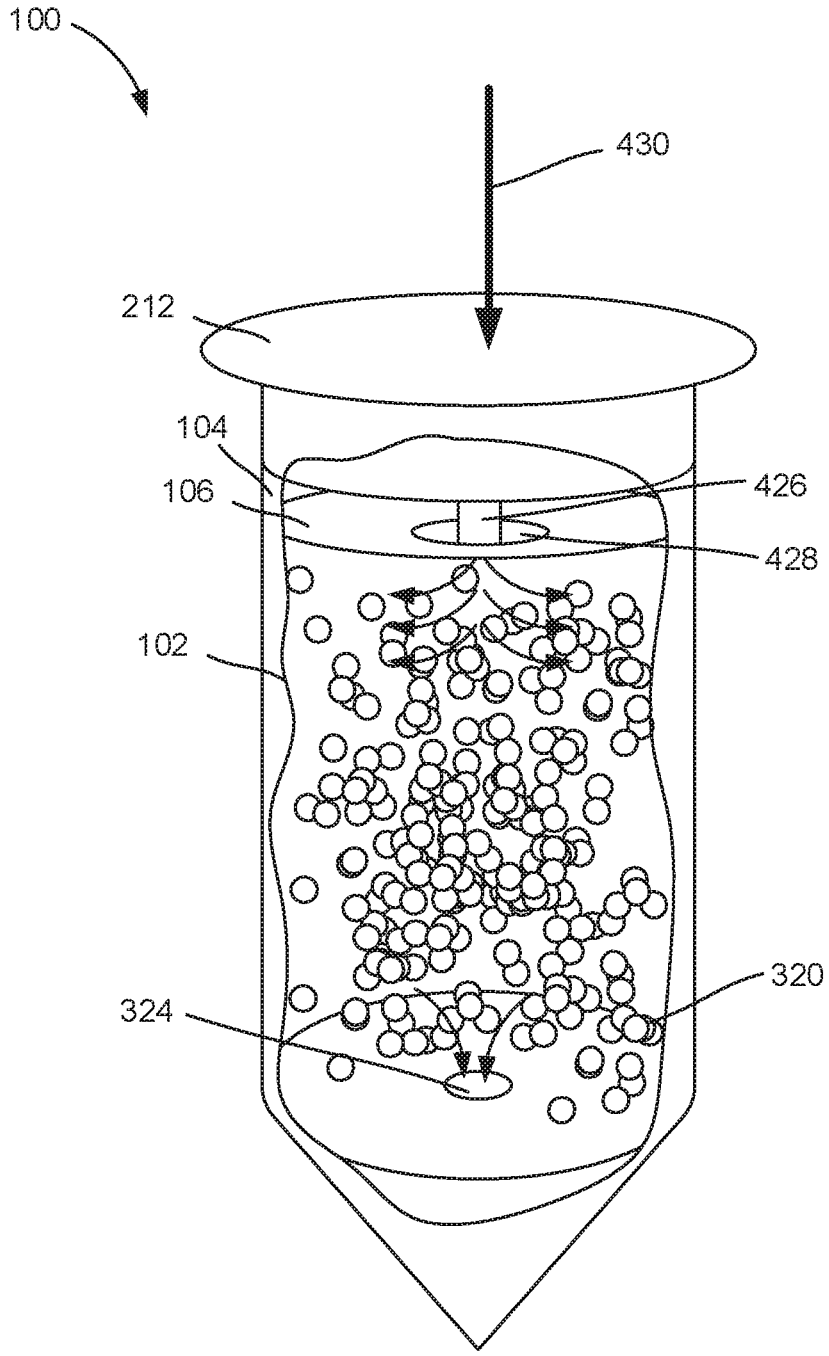

FIGS. 4A and 4B are views of a refill container (100) with a pressurized fluid chamber (104), according to an example of the principles described herein. More specifically, FIGS. 4A and 4B depict the refill container (100) with a portion of the housing (FIG. 2, 210) removed to illustrate components therein. FIGS. 4A and 4B depict an example where the chamber (104) is a sealed chamber, the wall (106) includes a valve (428), and the pressure release device (FIG. 1, 108) opens the valve (428). For example, the pressure release device (FIG. 1, 108) may be a plunger (426) that depresses against the valve (428) to open it.

More specifically, FIG. 4A is a view before opening of the valve (428) and FIG. 4B is a view following the opening of the valve (428). As described above, the print compound (320) at rest in a reservoir (102) may be difficult to mobilize out of the reservoir (102). However, as the valve (428) is opened as described in FIG. 4B, the print compound (320) readily flows out the outlet (FIG. 3, 324).

As with the pin (FIG. 3, 318), the plunger (426) may be actuated in any number of ways including a translation and/or a rotation of the trigger (FIG. 1, 110) which in this case is a cap (212) of the refill container (100). While FIGS. 3A and 4A depict a few particular examples of triggers (FIG. 1, 110) in the form of the pin (FIG. 3, 318) and the plunger (426), any variety of triggers (FIG. 1, 110) with a variety of activation actions may be used in accordance with the examples described herein.

FIG. 4B depicts the refill container (100) following activation of the pressure release device (FIG. 1, 108). That is, the plunger (426) has depressed against, and opened, the valve (428). In the example depicted in FIG. 4B, such an activation results from a user, or a component within the printing system, translating the cap (212) in a direction indicated by the arrow (430). That is, as the cap (212) is pushed down, the plunger (426) is also pushed down to open the valve (428). While FIG. 4B depicts a translation of the cap (212), other actions may activate the pressure release device (FIG. 1, 108) such as a rotation of the cap (212) or other mechanical activity.

As described above, when the cap (212) causes the pressure release device (FIG. 1, 108) to open the valve (428), the contents of the chamber (104), that is the pressurized fluid, rushes into the lower pressure reservoir (102) as indicated by the arrows. Such an action disturbs or agitates the print compound (320) such that it mobilizes throughout the space within the reservoir (102). In such an agitated state, the print compound (320) is more disposed to be acted upon by a mobilizing energy. The energy of the rushing pressurized fluid is such a mobilizing energy and pushes the print compound (320) through the outlet (324) indicated. That is, the released pressure that results from the opening of the valve (428), increases the rate of print compound (320) release by 1) agitating the print compound (320) into a state where it is more readily acted upon by an external force and 2) providing a force that directs the print compound (320) through the outlet (324). The increased mobility and directed force produced by the pressurized fluid results in a greater rate, and a greater overall volume, of ejected print compound (320). That is, less print compound (320) remains in the refill container (100) thus resulting in a more efficient refill operation.

In some examples, the pressure release device (FIG. 1, 108), for example the cap (212), may lock into place following activation of the pressure release device (FIG. 1, 108). For example, a user may depress or twist the cap (212) and a locking mechanism may retain the cap (212) in place for at least the duration of the refill operation. Such a locking of the cap (212) may prevent a user from having to press the cap (212) for the duration of the refill operation.

By comparison, in some examples, a spring force may return the cap (212) to its original position, wherein the valve (428) is closed again. In this example, a user, or the printing system, may expel less than the full contents of the refill container (100). For example, a user may "top off" the printing system reservoir while reserving a portion of the print compound (320) in the refill container (100).

Figure 5A:
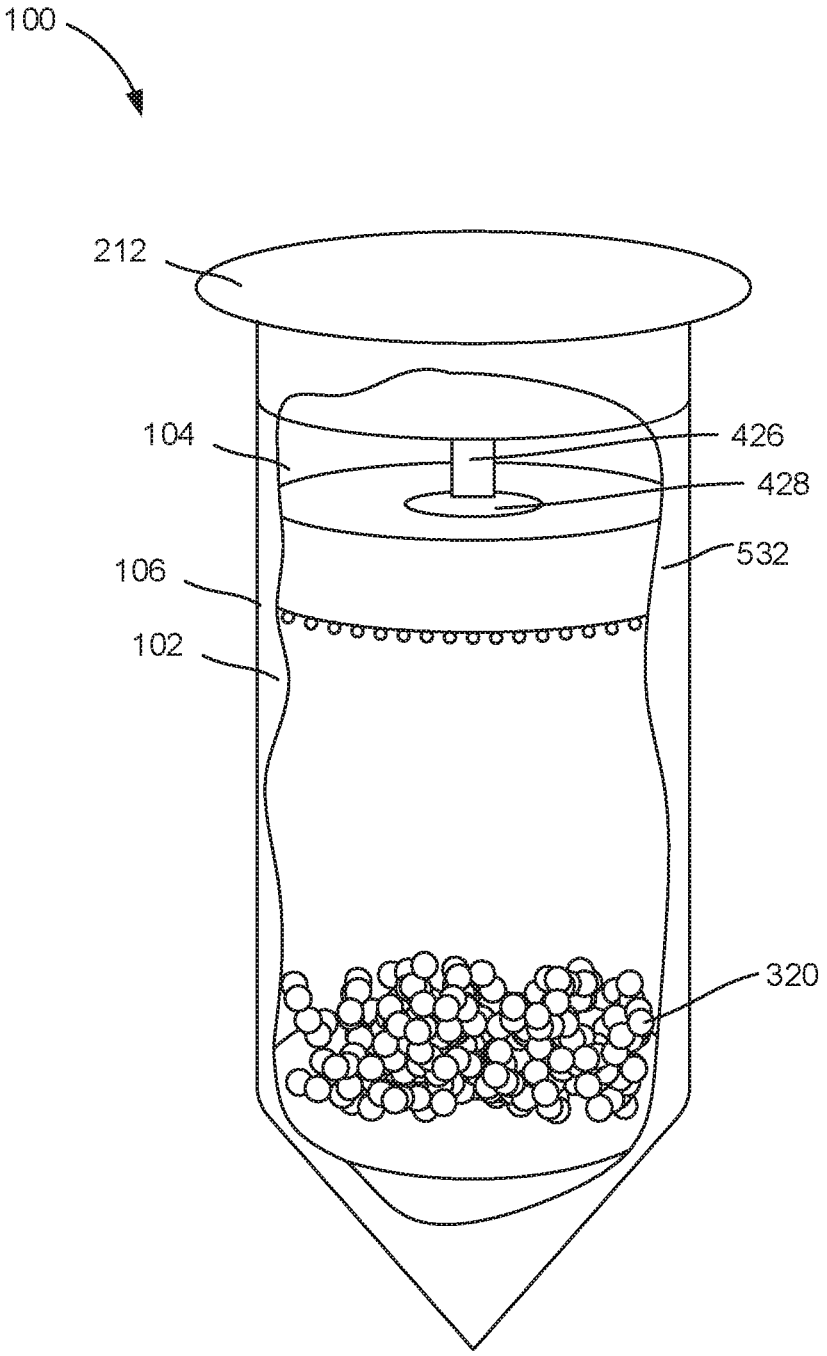
FIGS. 5A and 5B are views of a refill container with a pressurized fluid chamber, according to another example of the principles described herein.
Figure 5B:
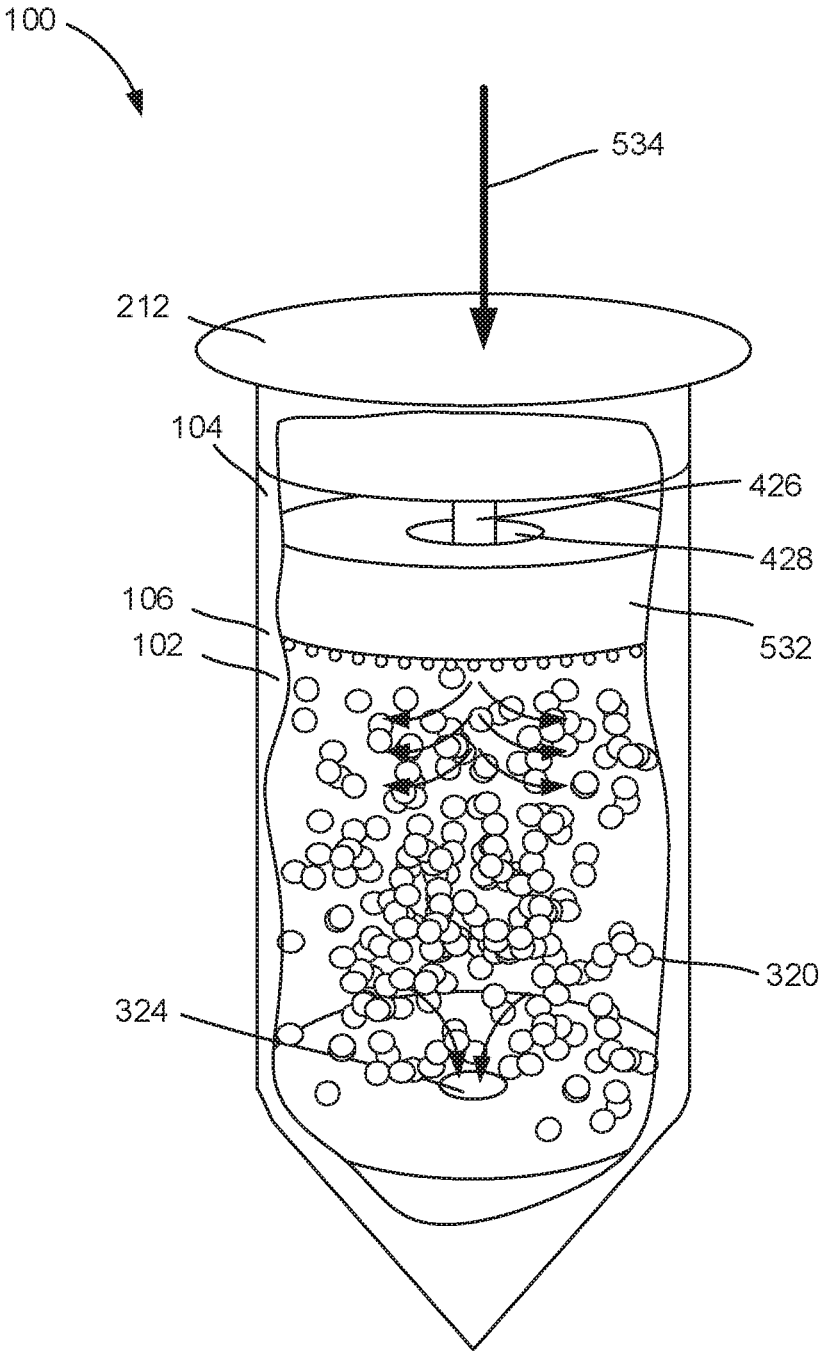

FIGS. 5A and 5B are views of a refill container (100) with a pressurized fluid chamber (104), according to another example of the principles described herein. That is, FIGS. 5A and 5B depict the refill container (100) with a portion of the housing (FIG. 2, 210) removed to illustrate components therein. FIGS. 5A and 5B depict an example where the chamber (104) includes a vessel (532) that stores the pressurized fluid. The vessel (532) is a self-contained unit that is inserted into the chamber (104). The vessel (532) may be of varying types. For example, the vessel (532) may be a rupturable bag that is ruptured by the pressure release device (FIG. 1, 108). In another example, the vessel (532) is a rigid vessel with a valve (428) that is opened by the pressure release device (FIG. 1, 108), which in the example depicted in FIG. 5A is a plunger (426). As described above, in these examples the rupture or opening of the vessel (532) results in pressurized fluid entering the reservoir (102) and agitating, or mobilizing the print compound (320) disposed therein such that it diffuses and is therefore more easily moved and transported out of the refill container (100).

In this example, the wall (106) holds the vessel (532) in place against the action of the pressure release device (FIG. 1, 108). Accordingly, the wall (106) may be permeable such that the pressurized fluid passes through. For example, the wall (106) may be a grate against which the vessel (532) is pressed and through which the pressurized fluid flows.

Using a vessel (532) to contain the pressurized fluid may be advantageous as it may avoid having to pressurize the chamber (104) during manufacture. Rather, the vessel (532) may be independently manufactured, and placed inside the chamber (104).

As with the above examples, FIG. 5A is a view before opening of the valve (428) and FIG. 5B is a view following the opening of the valve (428). As described above, the print compound (320) at rest in a reservoir (102) may be difficult to mobilize out of the reservoir (102). However, as the valve (428) is opened as described in FIG. 5B, the print compound (320) readily flows out the outlet (FIG. 3, 324).

The plunger (426), or a pin (FIG. 3, 318) in the case the vessel (532) is rupturable, may be actuated in any number of ways including a translation and/or a rotation of the trigger (FIG. 1, 110) which in this case is a cap (212) of the refill container (100).

FIG. 5B depicts the refill container (100) following activation of the pressure release device (FIG. 1, 108). That is, the plunger (426) has depressed against, and opened, the valve (428) in the vessel (530). In the example depicted in FIG. 5B, such an activation results from a user, or a component within the printing system, translating the cap (212) in a direction indicated by the arrow (534). That is, as the cap (212) is pushed down, the plunger (426) is also pushed down to open the valve (428). While FIG. 5B depicts a translation of the cap (212), other actions may activate the pressure release device (FIG. 1, 108) such as a rotation of the cap (212) or other mechanical activity.

When the cap (212) causes the pressure release device (FIG. 1, 108) to open the valve (428) in the vessel (532), the contents of the vessel (532), that is the pressurized fluid, rushes into the lower pressure reservoir (102) as indicated by the arrows. Such an action disturbs or agitates the print compound (320) such that it mobilizes throughout the space within the reservoir (102). In such an agitated state, the print compound (320) is more disposed to be acted upon by a mobilizing energy. The energy of the rushing pressurized fluid is such a mobilizing energy and pushes the print compound (320) through the outlet (324) indicated. That is, the released pressure that results from the opening of the valve (428) in the vessel (532), increases the rate of print compound (320) release by 1) agitating the print compound (320) into a state where it is more readily acted upon by an external force and 2) providing a force that directs the print compound (320) through the outlet (324). The increased mobility and directed force produced by the pressurized fluid results in a greater rate, and a greater overall volume, of ejected print compound (320). That is, less print compound (320) remains in the refill container (100) thus resulting in a more efficient refill operation.

Figure 6:
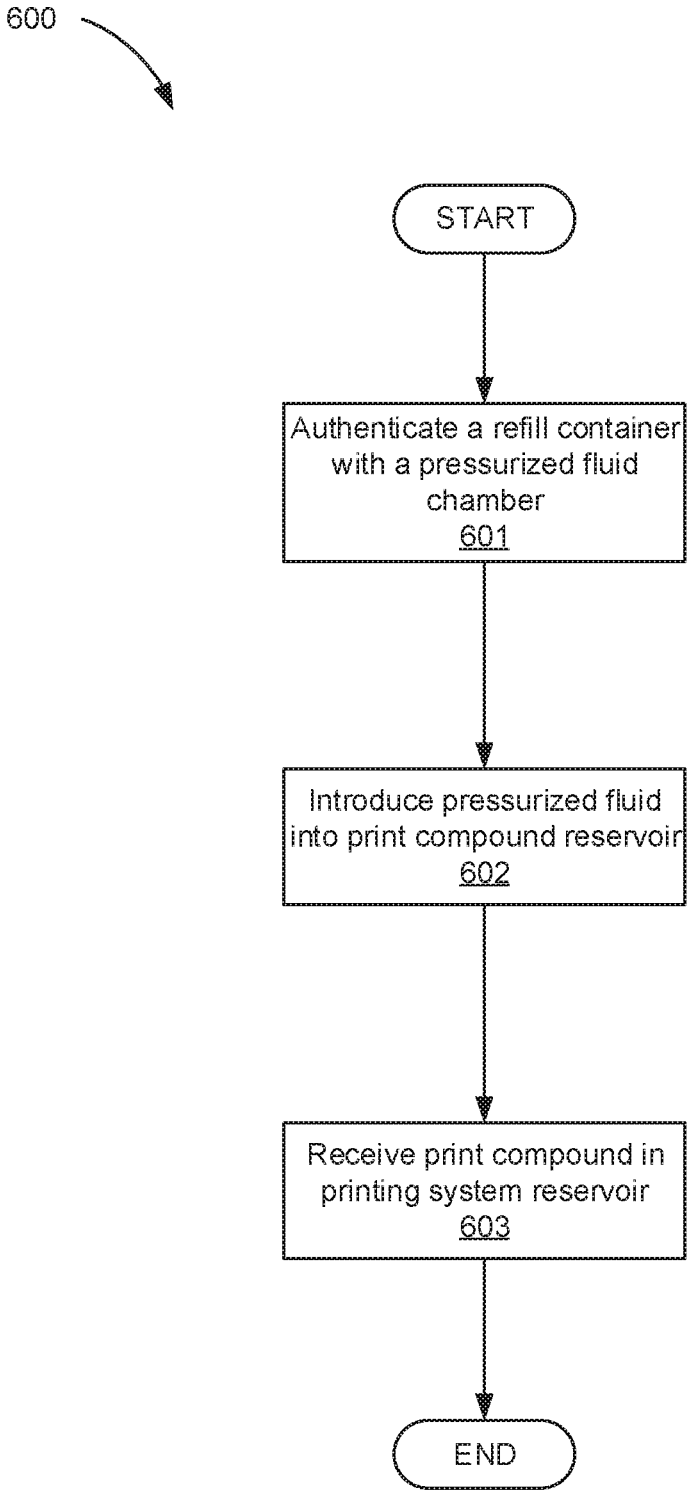
FIG. 6 is a flow chart of a method for refilling a print compound using a refill container with a pressurized fluid chamber, according to another example of the principles described herein.

FIG. 6 is a flow chart of a method (600) for refilling a print compound (FIG. 3, 320) using refill container (FIG. 1, 100) with a pressurized fluid chamber (FIG. 1, 104), according to an example of the principles described herein. According to the method (600), a refill container (FIG. 1, 100) with a chamber (FIG. 1, 104) is authenticated (block 601). That is, a manufacturer may desire certain management control over the print compound (FIG. 3, 320) used in their printing systems. Unauthorized print compounds (FIG. 3, 320) may result in reduced quality or even damage to the printing system. A user may inadvertently attribute these less than satisfactory conditions to the manufacturer. Accordingly, a manufacturer may include an authentication operation in preparation for a print compound (FIG. 3, 320) refill. Such an authentication operation may include reading an encoded identifier from a security device (FIG. 2, 216) on the refill container (FIG. 1, 100). For example, the encoded identifier may be a serial number, a QR code, a bar code, or other human-indiscernible feature.

In some examples, the authentication (block 601) of the refill container (FIG. 1, 100) may be triggered by insertion of the refill container (FIG. 1, 100) into the printing system. That is, the printing system may include a sensor that detects whether a refill container (FIG. 1, 100) has been installed. If so, the printing system may activate a component to authenticate the refill container (FIG. 1, 100). In another example, the authentication (block 601) of the refill container (FIG. 1, 100) is separate from the insertion of the refill container (FIG. 1, 100) into the printing system. That is, a user may insert the refill container (FIG. 1, 100) and then independently trigger the authentication (block 601), for example by inputting a command at a user interface.

Following authentication (block 601) of the refill container (FIG. 1, 100) in any of its forms, the print compound (FIG. 3, 320) may be agitated. Specifically, prior to authentication, a mechanical device such as a stop may block the action of the trigger (FIG. 1, 110) to release the pressurized fluid into the print compound reservoir (FIG. 1, 102). Following the authentication (block 601) the printing system may adjust the mechanical device such that the trigger (FIG. 1, 110) may be activated, either by the user or a component within the printing system or refill container (FIG. 1, 100). Activation of the trigger (FIG. 1, 110) actuates the pressure release device (FIG. 1, 108) which introduces (block 602) the pressurized fluid into the print compound reservoir (FIG. 1, 102). As described above, such fluid coupling may include rupturing a bag or membrane, opening a valve (FIG. 428), or any other number of operations.

The introduction (block 602) of the pressurized fluid agitates the print compound (FIG. 3, 320) in the reservoir (FIG. 1, 104), diffusing it from a resting state. Such diffusion serves to increase the mobility of the print compound (FIG. 3, 320), that is the diffusion makes the print compound (FIG. 3, 320) more responsive to an external force.

The introduction (block 602) of the pressurized fluid also provides the external force that moves the print compound (FIG. 3, 320) out of the refill container (FIG. 1, 100). That is, the refill container (FIG. 1, 100) may have an outlet (FIG. 3, 324) through which print compound (FIG. 3, 320) exits the refill container (FIG. 1, 10) and is received (block 603) into the printing system, and more specifically into the printing system reservoir. Thus, the present method (600) allows for the facile movement of a greater portion of the print compound (FIG. 3, 320) disposed within a reservoir (FIG. 1, 102) into the printing system. Such a method (600) reduces the physical exertion required by a user and may reduce the likelihood of user error.

Figure 7:
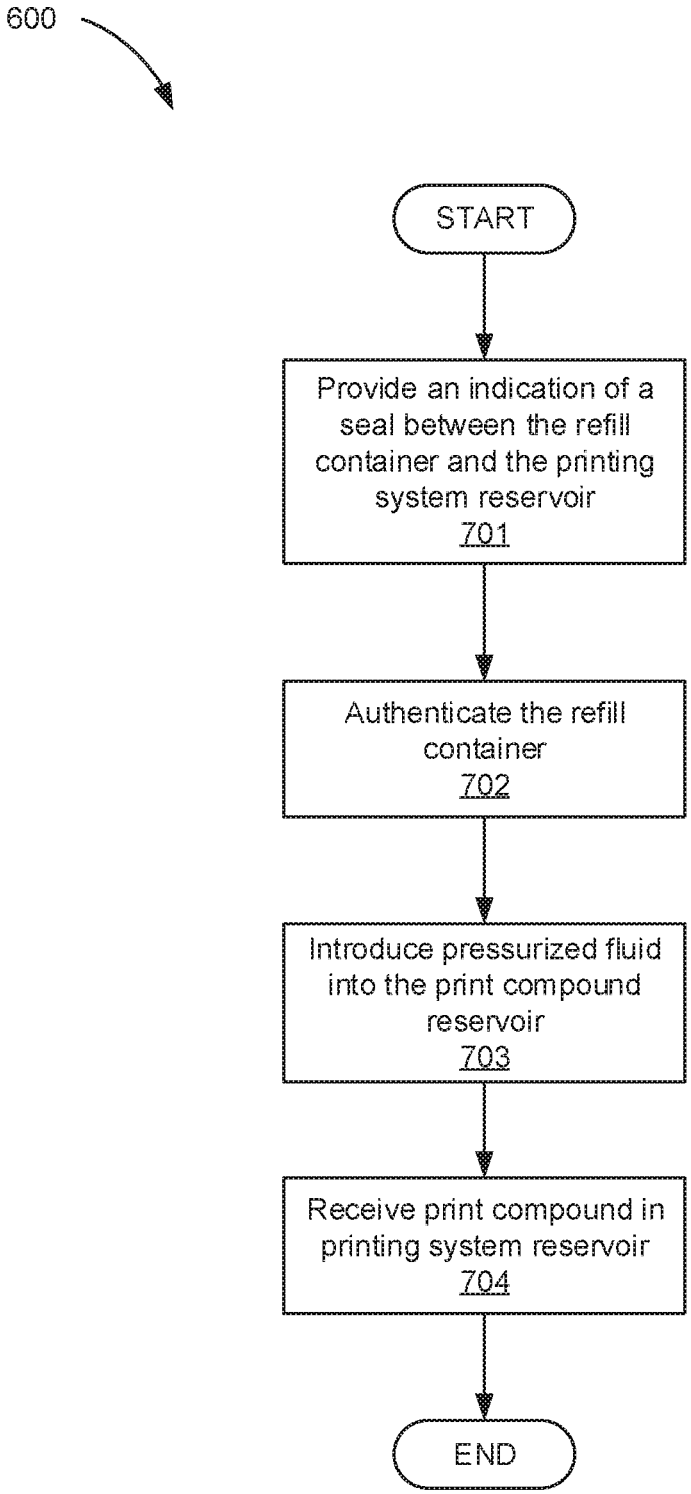
FIG. 7 is a flow chart of a method for refilling a print compound using a refill container with a pressurized fluid chamber, according to another example of the principles described herein.

FIG. 7 is a flow chart of a method (700) for refilling a print compound (FIG. 3, 320) using a refill container (FIG. 1, 100) with a pressurized fluid chamber (FIG. 1, 104), according to an example of the principles described herein. In this example, prior to authenticating the refill container (FIG. 1, 100) and expelling the contents therein, the printing system may provide (block 701) an indication of a seal between the refill container (FIG. 1, 100) and the printing system reservoir. If such a seal does not exist, any refill operation may result in spilled, and therefore wasted, print compound (FIG. 3, 320). Such a spill may be messy, could potentially clog other components of the printing system, and may be a nuisance to a user. Accordingly, the printing system may include sensors to determine whether such a seal has been generated, and provide (block 701) a notification of the seal.

Responsive to such an indication, the refill container (FIG. 1, 100) is authenticated (block 702), the pressurized fluid introduced (block 703), and the print compound (FIG. 3, 320) received (block 704) into the printing system reservoir. These operations may be performed as described above in connection with FIG. 6.

In summary, using such a refill container 1) eliminates the need for a user to use their own physical force to pressurize the internal volume of the refill container; 2) eliminates the need for multiple external components to eject the print compound; 3) simplifies the print compound refill operation; and 4) simplifies manufacturing and transportation logistics by reducing the overall size of the refill container.

What is claimed is:

1. A refill container comprising:

a reservoir to house a volume of print compound;

a chamber to house a pressurized fluid;

a wall to separate the reservoir from the chamber, wherein the chamber is sealed from the reservoir by the wall;

a pressure release device to create a fluid path through the wall between the chamber and the reservoir such that the pressurized fluid flows from the chamber into the reservoir to mix with the volume of print compound; and a trigger to activate the pressure release device.

2. The refill container of claim 1, wherein the pressurized fluid comprises a pressurized gas.

3. The refill container of claim 1, wherein:

the wall comprises a membrane; and the pressure release device is to rupture the membrane when the pressure release device is activated.

4. The refill container of claim 1, wherein:

the wall comprises a valve; and the pressure release device is to open the valve when the pressure release device is activated.

5. The refill container of claim 1, wherein:

the chamber houses a vessel in which the pressurized fluid is stored; and the vessel comprises a rupturable bag to be ruptured by the pressure release device.

6. The refill container of claim 1, wherein the trigger performs at least one of translation and rotation to activate the pressure release device.

7. The refill container of claim 1, wherein the pressure release device comprises at least one of:

a lever to displace a portion of the wall; and a device to pull the wall away from reservoir sidewalls.

8. The refill container of claim 1, further comprising a security device including information to authenticate the refill container.

9. The refill container of claim 1, wherein the chamber comprises:

a first sub-chamber including a first liquid; and a second sub-chamber including a second liquid, wherein a rupturing of a seal between the first sub-chamber and second sub-chamber allows the first liquid and second liquid to mix and convert into a gaseous form to provide the pressurized fluid.

10. The refill container of claim 1, wherein the pressurized fluid comprises a liquid under pressure when the liquid is sealed in the chamber by the wall, and the liquid becomes gaseous when the fluid path is created through the wall.

11. The refill container of claim 1, wherein:

the chamber houses a rigid vessel in which the pressurized fluid is stored, and the rigid vessel comprises a valve to be opened by the pressure release device.

12. A method comprising:

authenticating a refill container coupled to a printing system, wherein the refill container includes a chamber and a reservoir to house a volume of print compound, the chamber to house a pressurized fluid;

following authentication of the refill container:

creating, based on activation of a pressure release device, a fluid path through a wall between the chamber and the reservoir, wherein the wall between the chamber and the reservoir seals the chamber from the reservoir prior to creating the fluid path through the wall;

agitating the print compound via introduction of the pressurized fluid from the chamber to the reservoir through the fluid path created through the wall; and receiving the print compound in a printing system reservoir.

13. The method of claim 12, wherein insertion of the refill container into the printing system triggers the authenticating and the agitating.

14. The method of claim 12, wherein the authenticating of the refill container is separate from an insertion of the refill container into the printing system.

15. The method of claim 12, further comprising:

providing an indication of a seal between the refill container and the printing system reservoir, wherein the authenticating of the refill container and the introduction of the pressurized fluid into the reservoir are responsive to the indication of the seal.

16. The method of claim 12, further comprising:

retracting a mechanical device that impedes a trigger of the pressure release device, wherein the pressure release device when triggered creates the fluid path through the wall.

17. The method of claim 16, wherein the mechanical device prior to retraction prevents the pressure release device from moving to create the fluid path through the wall.

18. The method of claim 17, wherein the mechanical device after the retraction allows the pressure release device to move to create the fluid path through the wall.

19. A refill container comprising:

a reservoir to house a volume of print compound used in a printing system;

a chamber to house a pressurized fluid;

a wall to separate the reservoir from the chamber, wherein the chamber is sealed from the reservoir by the wall;

a pressure release device to create a fluid path through the wall between the chamber and the reservoir such that the pressurized fluid flows from the chamber through the fluid path into the reservoir to agitate the volume of print compound;

a cap comprising a trigger to activate the pressure release device; and a security device including information to authenticate the refill container.

20. The refill container of claim 19, wherein the wall comprises a membrane and the pressure release device is to rupture the membrane to create the fluid path through the wall.

* * * * *